United States Patent [19]

Kelly

[11] Patent Number: 5,048,825

[45] Date of Patent: Sep. 17, 1991

[54] PORTABLE DOORWAY AND FLOOR STAND EXCERCISER FOR USE BY WHEELCHAIR OCCUPANTS.

[76] Inventor: Peggy L. Kelly, 76 Shore Dr., Clinton, Miss. 39056

[21] Appl. No.: 582,108

[22] Filed: Sep. 14, 1990

[51] Int. Cl.[5] ..... A63B 21/00; A63B 21/06

[52] U.S. Cl. ..... 272/117; 272/119; 272/62; 272/900

[58] Field of Search ..... 272/117, 119, 120, 900, 272/118, 62; 128/25 R, 94

[56] References Cited

U.S. PATENT DOCUMENTS

| | | | |
|---|---|---|---|
| 864,188 | 8/1907 | Patterson | 272/120 |
| 2,460,589 | 2/1949 | Lewis | 128/94 |
| 3,199,509 | 8/1965 | Smith | 128/94 |
| 3,716,232 | 2/1973 | Johnson et al. | 272/62 |
| 3,826,490 | 7/1974 | Mossman | 272/900 |
| 3,858,874 | 1/1975 | Weider | 272/900 |
| 3,923,050 | 12/1975 | Zeide et al. | 128/94 |
| 4,072,308 | 2/1978 | Applegate | 272/117 |
| 4,109,907 | 8/1978 | Zito | 272/117 |
| 4,619,453 | 10/1986 | Plumridge | 272/117 |
| 4,896,881 | 1/1990 | Djerdjerian | 272/900 |
| 4,955,604 | 9/1990 | Pogue | 272/117 |

*Primary Examiner*—Richard J. Apley
*Assistant Examiner*—Lynne A. Reichard
*Attorney, Agent, or Firm*—Fleit, Jacobson, Cohn, Price, Holman & Stern

[57] ABSTRACT

An exercise device especially adapted for use by wheelchair occupants. The exercise device includes an elevated supporting structure which in one embodiment is a clamp assembly supported from the top of a doorway frame and in another embodiment is a clamp assembly supported by an adjustable frame which includes vertically elongated and adjustable side members interconnected by a top member having a longitudinally adjustable slide thereon for engagement by the clamp assembly. In each form of the invention, a wheelchair and its occupant can be positioned below the clamp assembly and to either side thereof to enable various types of attachments to be connected with the clamp assembly. Various interchangeable attachments are provided to enable a wheelchair occupant to practice various exercise regimens. The exercise device can be used in hospitals, homes, offices, therapy establishments and in other areas where portable exercise devices for use by wheelchair occupants is desired.

11 Claims, 3 Drawing Sheets

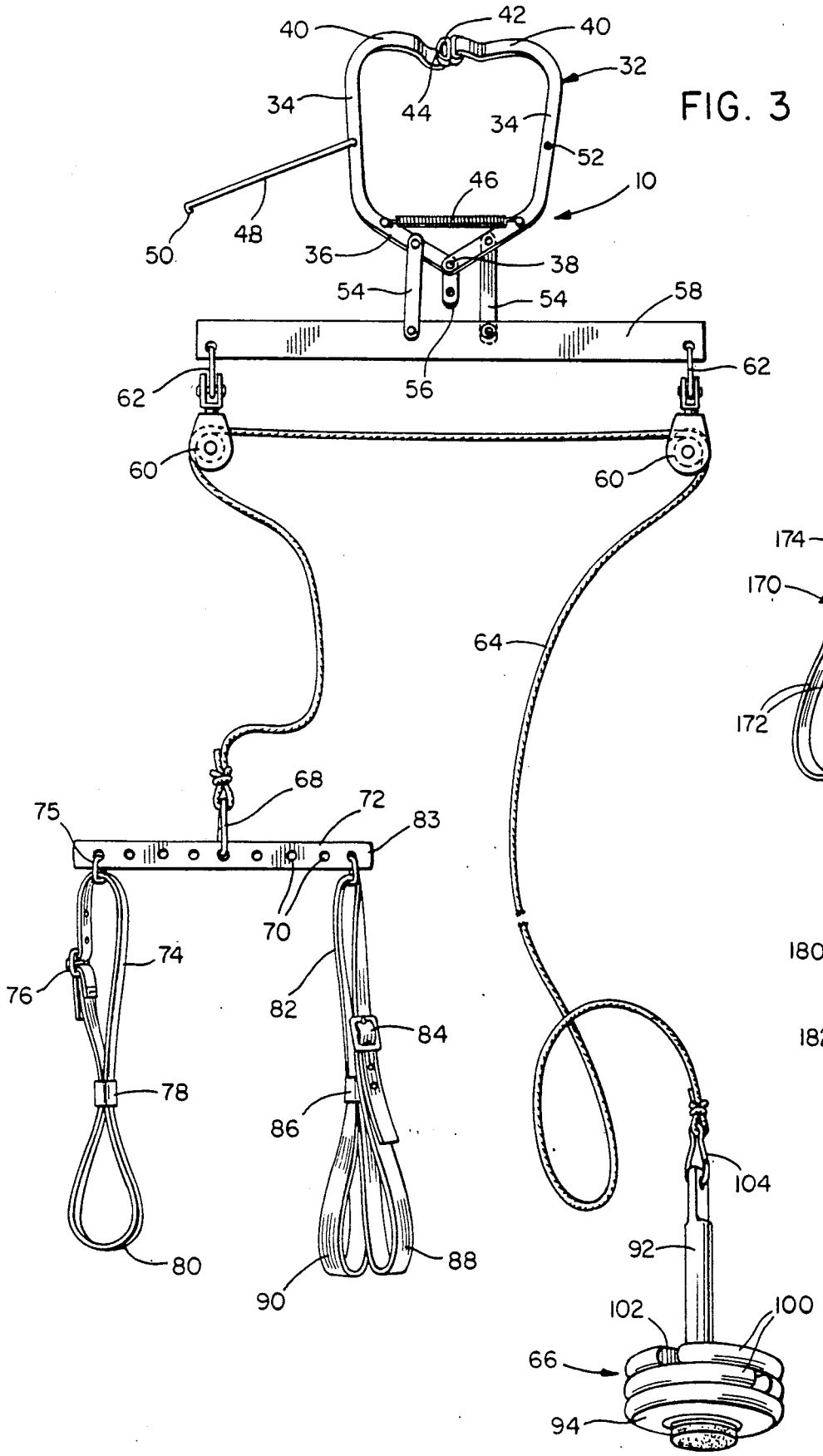
FIG. 3
FIG. 11
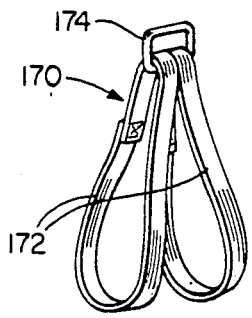
FIG. 12
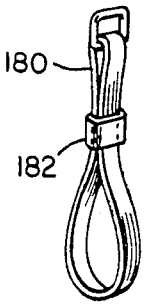

PORTABLE DOORWAY AND FLOOR STAND EXCERCISER FOR USE BY WHEELCHAIR OCCUPANTS.

BACKGROUND OF THE INVENTION

1. FIELD OF THE INVENTION

The present invention generally relates to an exercise device and more specifically an exercise device especially adapted for use by wheelchair occupants. The exercise device includes an elevated supporting structure which in one embodiment is a clamp assembly supported from the top of a doorway frame and in another embodiment is a clamp assembly supported by an adjustable frame which includes vertically elongated and adjustable side member interconnected by a top member having a longitudinally adjustable slide thereon for engagement by the clamp assembly. In each form of the invention, a wheelchair and its occupant can be positioned below the clamp assembly and to either side thereof to enable various types of attachments to be connected with the clamp assembly. Various interchangeable attachments are provided to enable a wheelchair occupant to practice various exercise regimens. The exercise device can be used in hospitals, homes, offices, therapy establishments and in other areas where portable exercise devices for use by wheelchair occupants is desired.

DESCRIPTION OF THE PRIOR ART

Various types of exercising equipment have been provided including various complex devices by which various muscle groups can be exercised and which include various motion resistance devices and structures engaged by the hands or other portions of the anatomy of the person using the equipment. The following U.S. patents generally relate to this field of endeavor:

| | |
|---|---|
| 1,048,750 | 3,923,050 |
| 2,460,589 | 4,072,308 |
| 2,916,034 | 4,109,907 |
| 3,199,509 | 4,610,244 |
| 3,826,490 | 4,619,453 |

The exercise devices disclosed in the patents listed above do not disclose the specific structure which enables a relatively simple exercise device to be effectively used by wheelchair occupants either by connecting the exercise device to the top member of a door frame or to a top member of a portable frame that is generally the same size as a door frame.

SUMMARY OF THE INVENTION

An object of the present invention is to provide an exercise device which includes a clamp assembly of unique construction that engages the top member of a door frame or a top member of an inverted U-shaped portable frame that simulates a door frame with the clamp assembly being positioned at selected points along either type of supporting frame for suspending exercise components therefrom for positioning at either side of the doorway or the frame which simulates a doorway thereby enabling a wheelchair occupant to perform various hand exercises, arm exercises and the like in an effective manner.

A further object of the invention is to provide an exercise device which includes a pulley support bar supported from the clamp assembly and including spaced pulleys thereon over which a flexible rope or cord is entrained with one end of the cord having a weight or weights attached thereto and the other end of the rope or cable having handle or gripping components thereon to enable a wheelchair occupant to exercise by moving the rope or cable in a linear manner to raise and lower the weights.

Another object of the invention is to provide an exercise device in accordance with the preceding objects in which the stand which simulates a door includes adjustable side frames and an adjustable slide on the top member to receive the clamp assembly with the lower end of the side frames including elongated support members disposed in the same vertical plane as the side frames to provide unobstructed movement of a wheelchair into and out of the frame in the same manner as a wheelchair can move into and out of a doorway.

Still another object of the invention is to provide an exercise device which is portable in nature and can be utilized in any doorway having a door frame or in association with a stand which simulates a door frame and includes interchangeable components to form weights and structures engaged by individuals using the exercise equipment thereby rendering the exercise device universal in use and effective for exercising various muscles and muscle groups and which is relatively inexpensive to manufacture and maintain.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 3 is a schematic elevational view of the exercise device of the present invention.

FIG. 11 is an elevational view of a V-strap which can be used to support the forearm.

FIG. 12 is an elevational view of a shorter wrist cuff or strap which can be used to support the wrist area

DESCRIPTION OF THE PREFERRED EMBODIMENTS

Figure 1:
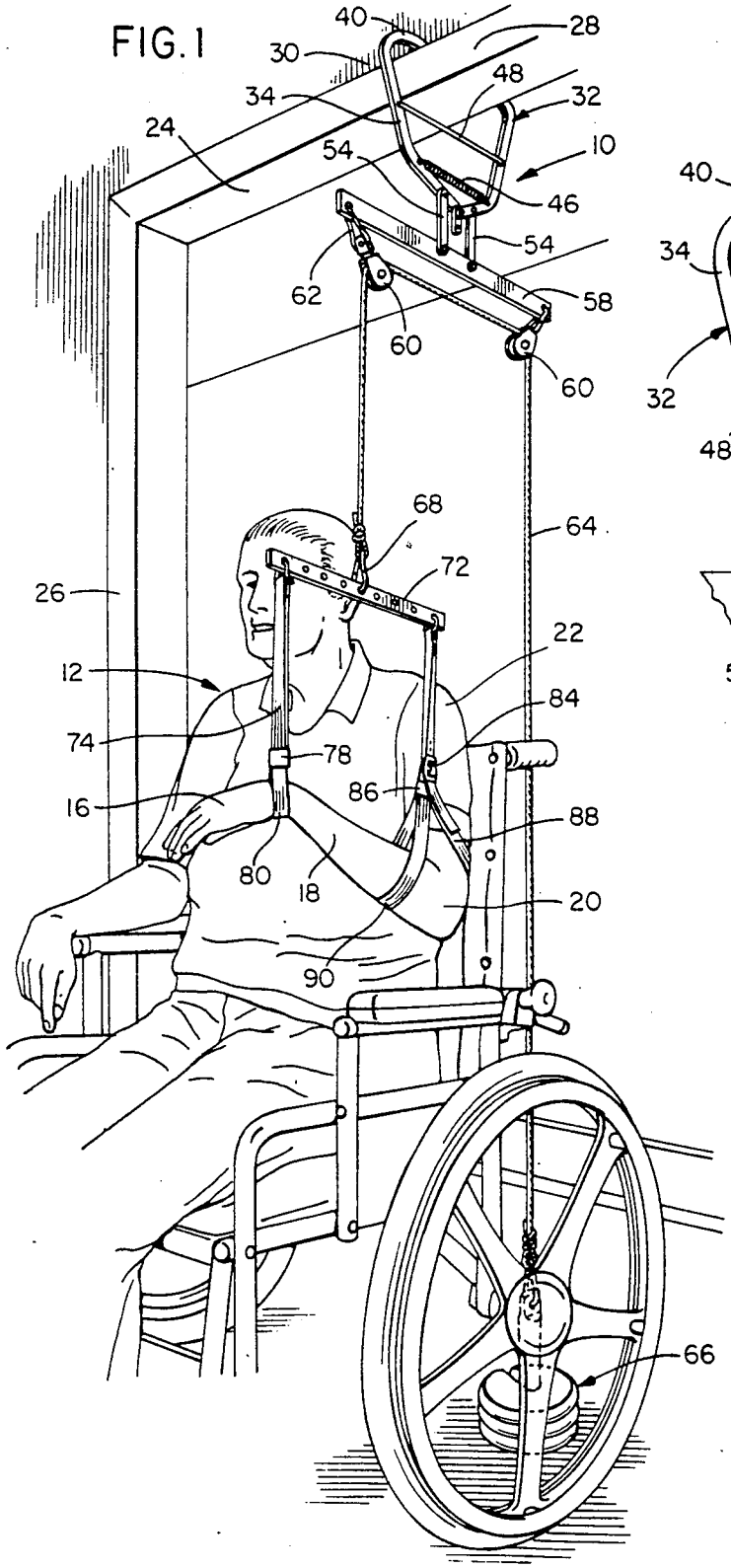
FIG. 1 is a perspective view of the exercise device of the present invention associated with a door frame and illustrating a wheelchair occupant using the device.
Figure 2:
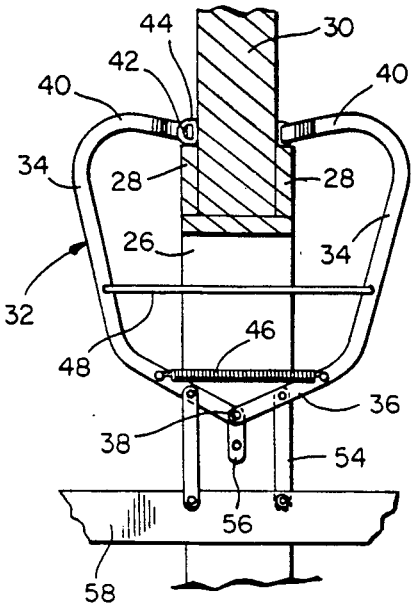
FIG. 2 is a side elevational view, on an enlarged scale, illustrating the structure of the clamp which engages the top of the door frame.

Referring now to FIGS. 1-5, the exercise device disclosed therein is generally designated by reference numeral 10 and is adapted for use by an occupant generally designated by reference numeral 12 of a wheelchair 14 to enable the occupant 12 to exercise the hand 16, arm 18, elbow 20, shoulder 22 or other portion of the anatomy of the wheelchair occupant 12. The exercise device is supported from the top member 24 of a door frame 26 and can be used whether or not a door is supported from the door frame with the wheelchair 14 being movable into and out of the doorway or passageway. As illustrated in FIG. 2, the top member 24 of the door frame includes a pair of vertical trim components 28 attached to a vertical wall structure 30 in a conventional and well-known manner.

Figure 6:
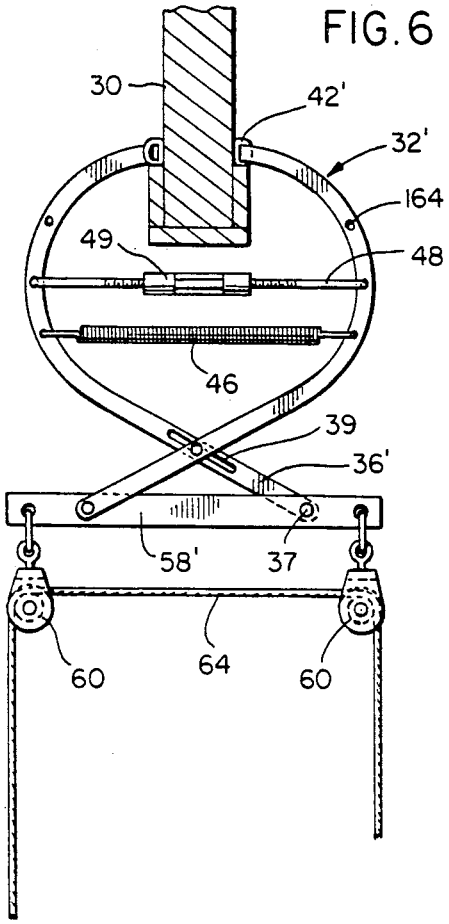
FIG. 6 is a side elevational view of a modified clamp assembly.

The exercise device 10 includes a clamp assembly 32 supported from the top member 24 of the door frame. The clamp assembly 32 includes a pair of generally arcuately curved clamp members 34 having inwardly inclined lower portions 36 that are pivotally interconnected by a pivot pin 38. Each of the clamp members 34 includes an inturned and downwardly curved upper end member 40 which terminates in a horizontally elongated member 42 having a covering 44 of cushioning material such as rubber, plastic or the like. The horizontal members 42 engage the top surface of the trim members 28 and the outer surface of the vertical wall 30 as illustrated in FIG. 2 to mount the clamp assembly 32 to the top member 24 of the door frame 26. A tension coil spring 46 interconnects the clamp members 34 adjacent to but spaced from the pivot pin 38 to spring bias the clamp members 34 into engagement with the wall surfaces 30. Spaced above the spring 46, the clamp members 34 are interconnected by a detachable locking rod 48 which has offset end portions 50 extending perpendicular from the rod 48 to be received in apertures 52 in the central portions of the clamp members 34 as illustrated in FIGS. 2 and 3. As illustrated in FIG. 6, the connecting rod 48 may be longitudinally adjusted by the use of any suitable adjustment mechanism such as a turnbuckle structure 49 or the like to securely clamp the clamp members 34 to the top member 24 of the frame and the surfaces of the wall 30 to anchor it in place but yet enable it to be readily removed and adjusted longitudinally along the length of the top member 24 or separated from the door frame altogether.

The clamp assembly 32 includes a pair of supporting links 54 connected thereto in spaced relation to the pivot pin 38 together with a central depending supporting link 56 connected to the pivot pin 38 as illustrated in FIG. 2. Supported from the pair of links 54 is an elongated pulley bar 58 having pulleys 60 connected to the opposite ends thereof by supporting loops or rings 62. An elongated, flexible rope or cable 64 is entrained over the pulleys 60 and depends from the pulleys 60 with one end of the cable or rope extending downwardly toward the floor surface to receive a weight assembly 66. The other end of the rope or cable 64 depends downwardly and includes a loop 68 connected to one of a plurality of longitudinally spaced apertures 70 in a support bar 72. The forward end of the support bar 72 includes a downwardly extending adjustable strap 74 supported from support bar 72 by a rigid loop or D-ring 75. The strap 74 includes a buckle adjustment 76 and a slide loop 78 to form a bottom loop 80 which can engage the hand or wrist area of the wheelchair occupant 12 as illustrated in FIG. 1. The opposite end of the bar 72 includes a supporting strap 82 supported by a ring 83. The strap 82 includes a buckle adjustment 84 and a slide loop 86 to form a pair of loops 88 and 90 to engage around the arm 18 of the wheelchair occupant 12 on opposite sides of the elbow 20 as illustrated in FIG. 1. This structure effectively supports the arm of a wheelchair occupant and enables the arm and adjacent muscles and joints to be exercised by the occupant moving the arm against the resistance of the weight assembly 66.

The structure of the weight assembly 66 is illustrated in FIG. 3 and includes a vertical member 92 having a bottom plate 94 attached thereto in the form of a disk which forms a minimum weight with additional disk weights 100 mounted thereon with each of the disk weights 100 including a radial slot 102 to enable the number of weight disks 100 to be varied. The vertical member 96 is attached to the lower end of the rope or cable 64 by an attaching loop or ring 104.

Figure 4:
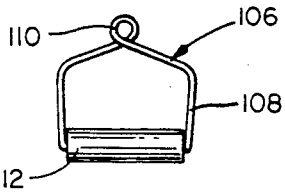
FIG. 4 is an elevational view of a handle component which can be connected to the exercise device.

FIG. 4 illustrates a handle structure 106 which can be attached to the rope or cable 64 to enable the hand 16 to grip the handle for exercise purposes. The handle 106 includes a wire loop structure 108 having an eye 110 at its upper end and a cylindrical sleeve 112 at its lower end which may be rigid or resilient material by which the handle 106 may be easily gripped.

Figure 5:
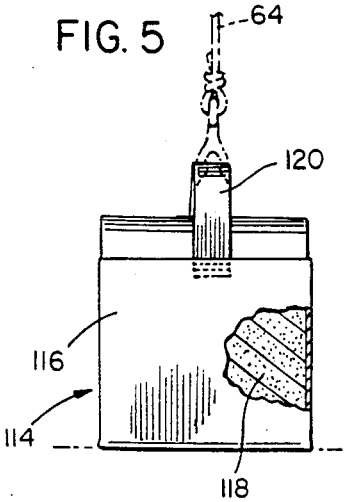
FIG. 5 is a side elevational view, with portions broken away, illustrating an alternative weight component.

FIG. 5 illustrates illustrates an alternative weight assembly 114 in the form of a flexible bag 116 receiving sand or other heavy granular material 118 therein. The bag 116 is attached to the cable or rope 64 by a loop strap 120 or other suitable attaching means. The quantity of granular weight material 118 in the flexible bag 116 may be varied to vary the weight attached to the rope or cable thereby varying the resistance to movement.

FIG. 6 illustrates a modified clamp assembly 32' in which curved clamp members 34' include straight end portions 36' which cross each other and are pivotally connected to the pulley bar 58' by pivot pins or bolts 37. At the point of intersection between the straight end portions 36', a pin and slot connection 39 is provided to enable the spring 46 to bias the ends 42' into engagement with the wall 30 and the adjustable rod 48 to secure the clamp assembly in place.

Figure 7:
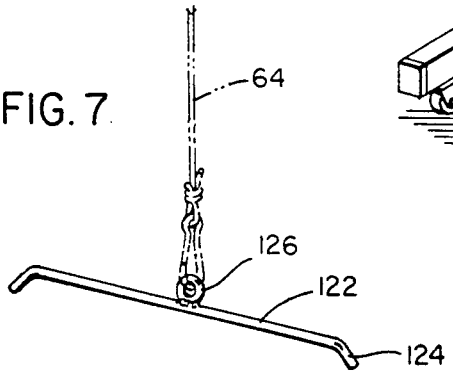
FIG. 7 is a perspective view of a curl bar for use with the exercise device.

FIG. 7 illustrates an elongated curl bar 122 with angulated ends 124 to form handles and a central eye 126 for attachment to the rope or cable 64.

Figure 8:
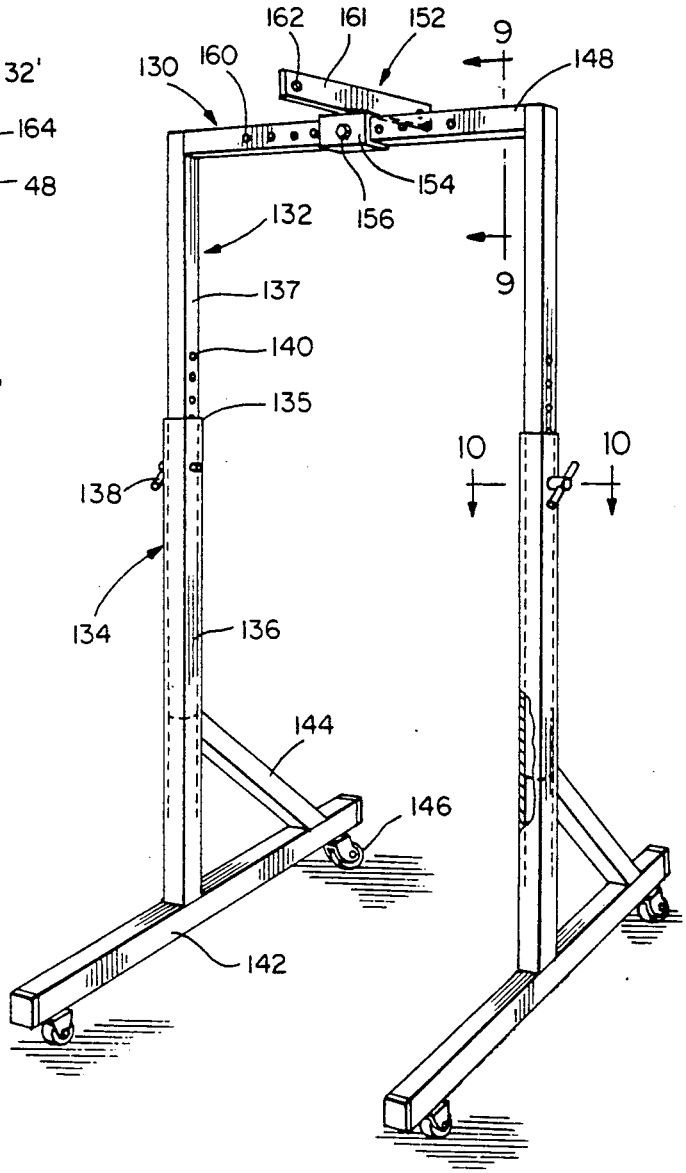
FIG. 8 is a perspective view of the portable frame embodiment of the invention.
Figure 9:
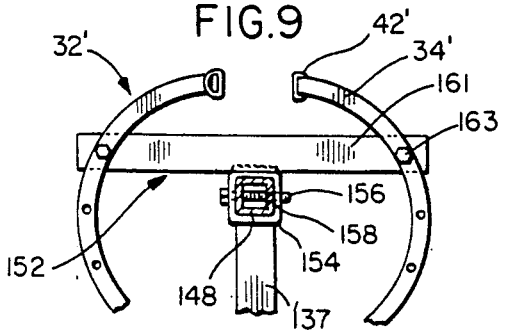
FIG. 9 is a sectional view taken along section line 9—9 on FIG. 8 illustrating the slide structure and associated clamp.
Figure 10:
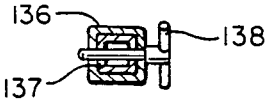
FIG. 10 is a sectional view taken along section line 10—10 on FIG. 8 illustrating the structure of the adjustable side frames.

FIGS. 8-10 illustrate a modified form of the exercise device of the present invention which is designated by reference numeral 130 and includes a generally inverted U-shaped frame structure 132 which forms a portable doorway and includes a pair of side frame members 134 which are vertically adjustable by a telescopic joint 135 including tubular lower members 136 and tubular upper members 137 secured in longitudinally adjusted position by a retaining T-pin or bolt 138 engageable through selective vertically apertures 140. The lower end of each side frame member 134 is rigidly affixed to a horizontal support side member 142 in the form of a bar or rail of solid or tubular construction with a brace 144 interconnecting the vertical side frame members 134 and the horizontal support side members 142 to retain them in rigid relationship. Each of the support side members 142 is provided with a pair of longitudinally spaced rollers or wheels 146 which facilitates movement of the frame 132 along a floor surface to a desired point of use. The rollers or wheels 146 may be provided with a locking mechanism to secure the frame stationarily in position. Locking mechanisms for the rollers or wheels are conventional and are found on many types of portable equipment provided with rollers, wheels or casters. This enables the frame 132 to be easily maneuvered to a desired position and supported stationarily on a supporting surface. It is pointed out that the supporting wheels and locking mechanism are optional features to enhance maneuverability. The adjustable side frame members 134 are interconnected by a top rail or member 148 which is equivalent to the top 24 of the door frame 26. The height of the frame can be adjusted to that of a door by the use of the telescopic connection 135 and the locking pin or bolt 138 and the telescopic arrangement also enables the frame to be collapsed for ease of storage.

Either clamp assembly 32 or 32' can be longitudinally adjustably supported from the top member 24 on wall 30 or on the top rail 148 on the frame structure 132. The clamp assembly 32' is illustrated in FIGS. 8 and 9 and includes a slide generally designated by reference numeral 152 which is mounted on top rail 148 and includes a longitudinal sleeve 154 slidable on the top rail 148 and secured adjustably thereto by a bolt or pin 156 that extends through aligned apertures 158 in the sleeve 154 and apertures 160 in the top rail 148. Rigidly affixed to the sleeve 154 is a transversely extending support member 161 having apertures 162 in each end thereof by which the clamp assembly 32' can be secured permanently by suitable bolts 163 extending through the apertures 160 and the support member 161 and apertures 164 in the arcuate clamp members 34'. Pop pins or T-pins can be used to detachably and temporarily secure the clamp members 34' of the clamp assembly 32' to the slide.

FIG. 11 illustrates a V-strap 170 which can be supported from the support bar 72 or from a cable or rope. The V-strap includes a pair of straps 172 supported from a rigid loop or ring 174 of square or rectangular configuration. The straps 172 are especially useful in supporting the forearm 18 and are interchangeable with the straps 74 and 82 in FIG. 3 to enable various exercises to be performed and providing effective support to either or both of the forearms. The straps 172 may be adjustable in length and provided with slides to adjust the straps 172 to more closely fit around the forearm.

FIG. 12 illustrates a wrist cuff or strap 180 which is shorter than and can be interchanged with wrist strap 74 illustrated FIG. 3. The strap 180 is attached to support bar 72 or a supporting cable or rope and can be adjustable and provided with a slide 182 to enable various exercises to be performed. Various attachments may be utilized with the exercise device including the elbow sling as illustrated in FIGS. 1 and 3, a wrist cuff and sling as illustrated in FIGS. 1 and 3, a shorter wrist cuff as illustrated in FIG. 12, and a shoulder sling and a V-strap as illustrated in FIG. 11 to engage the forearm. Also, the single grip handle as illustrated in FIG. 4 may be utilized as well as a curl bar illustrated in FIG. 7, all of which can be used singly or in combination and adjustably attached to the support bar 72 for proper positioning and adjustment of the exercise component which engages the user 12. Also, the rope or cable may be 6' to 8' long and provided with either the T-type plate holder weight illustrated in FIG. 3 or the bag-type weight illustrated in FIG. 5 with the weight being varied depending upon the requirements of the user and the exercise regimens to be followed. The various attachments are interchangeable to allow for a variety of exercises to be used and are attached to the rope or cable or to the support bar in a manner which enables them to be easily changed for customizing the exercise device to the user.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. An exercise device comprising a clamp assembly, an elevated support structure supporting said clamp assembly, said clamp assembly including means releasably engaging the support structure, and user engaging exercise apparatus supported from said clamp assembly, said clamp assembly including a pair of arcuately curved clamp members having inwardly and downwardly inturned upper ends and lower ends supporting said apparatus, said exercise apparatus including means for engaging a wheelchair occupant to enable the wheelchair occupant to follow exercise regimens, and weight means connected with the means for engaging a wheelchair occupant to resist movement of said means, said exercise apparatus including an elongated support bar having a pulley at each end, means connecting said bar to said clamp members, a flexible line entrained over said pulleys, said weight means being connected to one end portion of the line and the wheelchair occupant engaging means being connected to the other end portion of the line, said elevated support structure being in the form of a door frame having horizontal trim strips defining upwardly facing shoulders, each of said clamp members including a horizontally disposed, elongated end member engaging the upwardly facing shoulders formed by the trim strips, said clamp members being spring biased toward each other to engage the end members of the clamp members with the shoulders formed by the trim strips, and a locking rod interconnecting said clamp members to securely retain the clamp members in engagement with the door frame and enabling the clamp members to be oriented to either side of the door frame to enable a wheelchair occupant to move a wheelchair into a doorway and exercise their hands, wrists, arms, elbows and shoulders at either side of the wheelchair.

2. The structure as defined in claim 1 wherein said means on the line for engaging a wheelchair occupant includes at least one adjustable sling formed by an adjustable strap.

3. The structure as defined in claim 1 wherein said means on the line for engaging a wheelchair occupant includes a pair of slings formed by adjustable straps and loops with one of the slings adopted to engage the hand and wrist area of a wheelchair occupant and the other of the slings including a pair of loops adopted to encircle the arm of the wheelchair occupant immediately below and above the elbow to support the arm generally in a horizontal position.

4. The structure as defined in claim 1 wherein said means for engaging a wheelchair occupant is in the form of a loop-type handle having an eye member for attachment to said one end portion of the flexible line.

5. The structure as defined in claim 1 wherein said means for engaging a wheelchair occupant includes a curl bar in the form of an elongated member having a central eye for connection to said one portion of the flexible line.

6. An exercise device comprising a clamp assembly, an elevated support structure supporting said clamp assembly, said clamp assembly including means releasably engaging the support structure, and user engaging exercise apparatus supported from said clamp assembly, said clamp assembly including a pair of arcuately curved clamp members having inwardly and downwardly inturned upper ends and lower ends supporting said apparatus, said exercise apparatus including means for engaging a wheelchair occupant to enable the wheelchair occupant to follow exercise regimens, and weight means connected with the means for engaging a wheelchair occupant to resist movement of said means, said exercise apparatus including an elongated support bar having a pulley at each end, means connecting said bar to said clamp members, a flexible line entrained over said pulleys said weight means being connected to one end portion of the line and the wheelchair occupant engaging means being connected to the other end portion of the line, said elevated support structure including an inverted U-shaped frame having vertically adjustable side frame members and parallel bottom side frame members to engage a support surface, said frame including a top member forming an elevated support member, a slide movably mounted on said top member, means connecting said clamp assembly to said slide for movement longitudinally along the length of the top member to vary the position of the clamp assembly in relation to a wheelchair occupant.

7. The structure as defined in claim 6 wherein said bottom side frame members include wheels to enable the frame to be moved to a desired location to facilitate use by a wheelchair occupant.

8. The structure as defined in claim 1 wherein said means for engaging a wheelchair occupant includes a V-strap for engaging and supporting the forearm, and means detachably connecting the V-strap to the support bar to enable interchange of said means engaging a wheelchair occupant.

9. An exercise device comprising a clamp assembly, an elevated support structure supporting said clamp assembly, said clamp assembly including means releasably engaging the support structure and user engaging exercise apparatus supported from the clamp assembly, means suspending said exercise apparatus from said clamp assembly, said clamp assembly including a pair of arcuately curved clamp members having inwardly and downwardly inturned upper ends, said lower ends of said curved clamp members being pivotally connected, said means supporting the exercise apparatus being connected with lower end portions of said clamp members, spring means interconnecting said clamp members intermediate the ends thereof to spring bias the upper ends of the clamp members toward each other, said exercise apparatus including an elongated support bar, pulley means supported from said support bar, a flexible line intrained over said pulley means, weight means connected to one end portion of the line and wheelchair occupant engaging means connected to the other end portion of the line, said elevated support structure comprising a horizontally disposed support means positioned in elevated relation above a wheelchair and a wheelchair occupant, said horizontal support means supporting said clamp assembly for horizontal movement in relation to the support means to position said support bar, pulley means and wheelchair occupant engaging means horizontally in different lateral relationships to a wheelchair and a wheelchair occupant thereby enabling a wheelchair occupant to follow exercise regimens with the wheelchair occupant engaging means in different lateral relationships to the wheelchair occupant.

10. The structure as defined in claim 9 wherein said horizontal support means is the top portion of a doorway having trim strips defining upwardly facing shoulders on opposite surfaces of a vertical wall above the doorway, the upper ends of said clamp members engaging the upwardly facing shoulders with the spring means enabling release of the upper ends of the clamp members from the shoulders to enable the clamp assembly to be moved laterally in relation to a wheelchair and wheelchair occupant positioned below the clamp assembly.

11. The structure as defined in claim 9 wherein said horizontal support means includes a top member of an inverted U-shaped frame, a slide member mounted on said top member, means locking the slide member in horizontally adjustable position on the top member, said means supporting the exercise apparatus from the supporting structure including fastening means securing the clamp members to the slide member for movement laterally of the inverted U-shaped frame to enable the exercise apparatus to be laterally positioned in relation to a wheelchair and wheelchair occupant positioned within the frame below the clamp assembly.

* * * * *